US005451969A

United States Patent [19]

Toth et al.

[11] Patent Number: 5,451,969

[45] Date of Patent: Sep. 19, 1995

[54] DUAL POLARIZED DUAL BAND ANTENNA

[75] Inventors: John F. Toth, Reading; Cosimo J. Favaloro, Concord; Jeffrey P. Lane, Haverhill, all of Mass.

[73] Assignee: Raytheon Company, Lexington, Mass.

[21] Appl. No.: 34,020

[22] Filed: Mar. 22, 1993

[51] Int. Cl.[6] ..... H01Q 13/08; H01Q 1/38

[52] U.S. Cl. ..... 343/781 CA; 343/700 MS; 343/725; 343/729

[58] Field of Search ..... 343/781 CA, 720, 725, 343/729, 840, 700 MS, 781 R, 781 P, 772, 786; H01Q 13/00, 13/08, 1/38

[56] References Cited

U.S. PATENT DOCUMENTS

| | | | |
|---|---|---|---|
| 3,832,716 | 8/1974 | Plunk et al. | 343/770 |
| 3,924,239 | 12/1975 | Fletcher et al. | 343/909 |
| 3,975,738 | 8/1976 | Pelton et al. | 343/872 |
| 4,017,865 | 4/1977 | Woodward | 343/781 CA |
| 4,126,866 | 11/1978 | Pelton | 343/754 |
| 4,656,487 | 4/1987 | Sureau et al. | 343/909 |
| 4,700,193 | 10/1987 | Sa et al. | 342/427 |
| 4,905,014 | 2/1990 | Gonzalez et al. | 343/909 |
| 5,034,750 | 7/1991 | Cardiasmenos | 342/188 |
| 5,041,840 | 8/1991 | Cipolla et al. | 343/781 R |
| 5,126,869 | 6/1992 | Lipchak et al. | 359/94 |
| 5,243,353 | 9/1993 | Nakahara et al. | 343/700 MS |
| 5,268,680 | 12/1993 | Zantos | 343/781 CA |

*Primary Examiner*—Donald Hajec
*Assistant Examiner*—Hoanganh Le
*Attorney, Agent, or Firm*—Donald F. Mofford

[57] ABSTRACT

An antenna system is described including a reflector antenna, responsive to radio frequency signals at a first frequency, having a first reflector surface, a second reflector surface and a Cassegrain feed. The antenna system further includes an array antenna having a plurality of antenna elements responsive to radio frequency signals having a second different frequency, wherein a center element is in a common location with the feed of the reflector antenna. With such an arrangement, an improved dual band antenna system is provided. By providing the center element of the array antenna in a common location with the feed of the reflector antenna, a dual band radio frequency antenna system is provided which is more compact with improved radiation characteristics than known similar configured antennas.

16 Claims, 12 Drawing Sheets

10
120
Σ
Δel
Δaz
Q
128
127a
127b
127c
126a
126b
126c
125
124a
124b
124c
122a
122b
122c
122d
S5+S6+S7+S8
S5+S6
S5−S6
S7+S8
S7−S8
S1+S2
S1−S2
S3+S4
S3−S4
(S1+S2+S5)−(S3+S4+S6)
(S1+S3+S7)−(S2+S4+S8)
S1+S2+S3+S4
S1+S2−S3−S4
S1−S2+S3−S4
S1−S2−S3+S4
S9
S5
S6
S7
S8
S1
S2
S3
S4
20i
20e
20f
20h
20g
20a
20b
20c
20d

DUAL POLARIZED DUAL BAND ANTENNA

BACKGROUND OF THE INVENTION

This invention relates to radar seekers used in guided missiles and more particularly to antenna systems for radar seekers operating at dual frequency bands.

As is known in the art, a reflector antenna generally includes a feed circuit and at least one conductive member generally referred to as a reflector. The feed circuit radiates RF energy at the reflector and the reflector directs the RF energy in a desired direction. Reflector antennas are used in those applications requiring an electrically large antenna having a high gain characteristic. In order to allow positioning of the feed element and electronics in a more convenient location, a dual reflector antenna system is sometimes used. One type of dual reflector antenna system is generally referred to as a Cassegrain reflector antenna.

A Cassegrain reflector antenna typically includes a first or main reflector having a parabolic shape with an aperture centrally disposed therein. A second, or subreflector having a hyperbolic shape is placed between the vertex of the main reflector and the prime focus of the main reflector. The precise location of the subreflector relative to the main reflector may be selected to provide an antenna having preselected electrical characteristics. A feed, generally referred to as a Cassegrain feed, is disposed in the aperture of the main reflector. In a transmit mode, the feed radiates electromagnetic energy at the subreflector. In a preferred situation, the subreflector intercepts substantially all of the electromagnetic energy and reflects such energy back toward the main reflector. The main reflector intercepts substantially all of the electromagnetic energy fed from the subreflector and reflects such electromagnetic energy in a desired direction. The geometrical arrangement of the parabolically shaped main reflector and the hyperbolically shaped subreflector are selected such that electromagnetic signals (or rays) reflected by the main reflector will be parallel.

As is also known, an array antenna includes a plurality of antenna elements disposed in an array in a manner wherein the radio frequency signals emanating from each of the plurality of antenna elements combine with constructive interference in a desired direction. In radar guided missiles, missile seeker antennas are often disposed on a gimbal. It is desirable in radar guided missiles to provide missile seeker antennas having polarimetric receive properties and which operate in dual frequency bands. In a radar guided missile application, a dual band dual polarized antenna must share a common radiating aperture to provide antenna radiation characteristics with high directivity and relatively low sidelobe levels at both bands. To operate in dual frequency bands, it is often necessary to provide two antenna assemblies and dispose such assemblies in the shared aperture. It is increasingly more difficult to dispose two antenna assemblies in a shared aperture in the small diameter of a missile.

SUMMARY OF THE INVENTION

With the foregoing background of this invention in mind, it is a primary object of this invention to provide a dual polarized dual band antenna with a common aperture.

Another object of this invention is to provide a dual band antenna with improved gain.

Still another object of this invention is to provide a dual band antenna with reduced sidelobe levels.

The foregoing and other objects of this invention are met generally by an antenna system including a reflector antenna, responsive to radio frequency signals at a first frequency, having a first reflector surface, a second reflector surface and a Cassegrain feed. The antenna system further includes an array antenna having a plurality of antenna elements responsive to radio frequency signals having a second different frequency, wherein a center element is in a common location with the feed of the reflector antenna. With such an arrangement, an improved dual band antenna system is provided. By providing the center element of the array antenna in a common location with the feed of the reflector antenna, a dual band radio frequency antenna system is provided which is more compact with improved radiation characteristics than known similar configured antennas.

BRIEF DESCRIPTION OF THE DRAWINGS

For a more complete understanding of this invention, reference is now made to the following description of the accompanying drawings, wherein.

DESCRIPTION OF THE PREFERRED EMBODIMENTS

Figure 1:
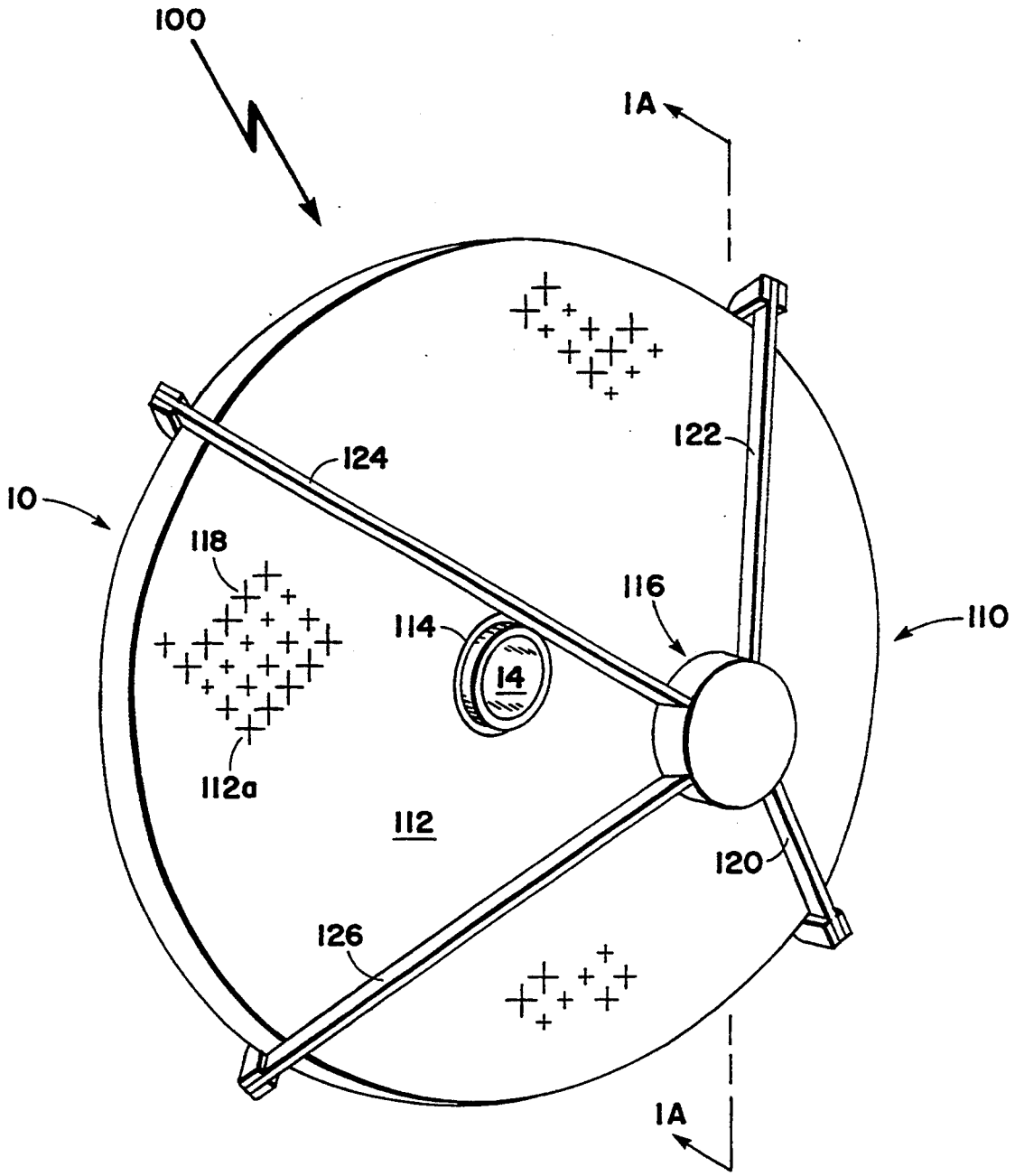
FIG. 1 is an isometric view of an antenna system according to the invention.
Figure 1A:
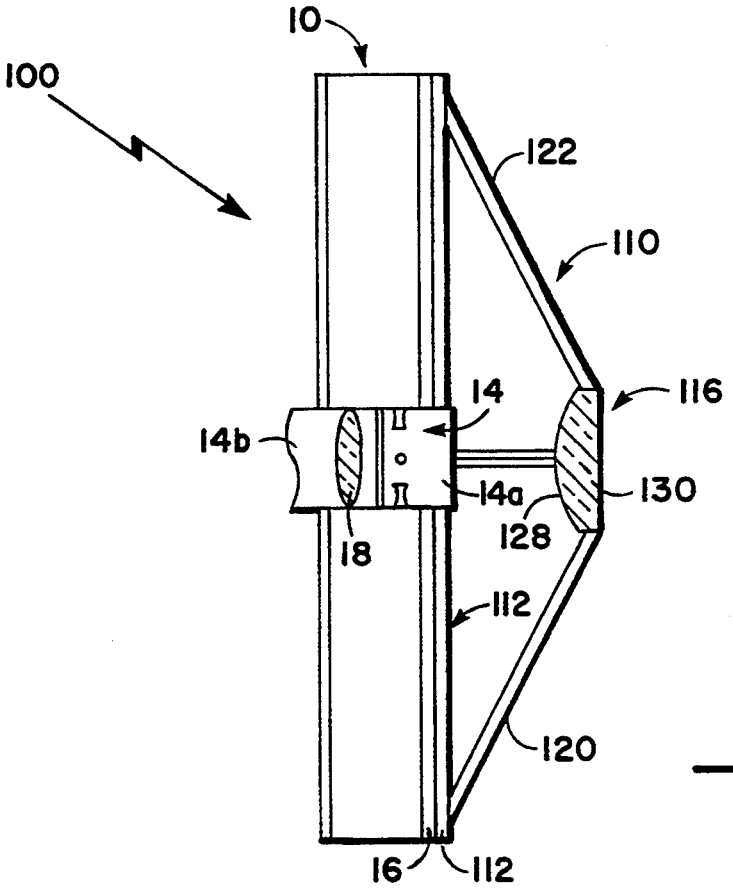
FIG. 1A is cross sectional view, somewhat distorted, of an antenna system according to the invention.

Referring now to FIGS. 1 and 1A, an antenna system 100 is shown to include a dual reflector antenna 110 (here adapted for W-band) having a main reflector 112 with an aperture 114. A feed circuit 14, having a first port **14*a* and a second port 14*b*, is disposed within the aperture 114. The feed circuit 14 is located at the apex of the main reflector 112 to minimize the blockage effects of an array antenna 10 mounted behind the main reflector 112. The main reflector 112 includes a dual dichroic surface 112*a* which will reflect W-band signals but pass other signals as described further hereinafter. The reflector antenna 110 further includes a subreflector 116 disposed in alignment with the feed circuit 14. The subreflector 116 includes a dichroic surface 128 with a foam support 130, wherein the dichroic surface 128 will reflect W-band signals but pass other signals. The antenna system 100 further includes the array antenna 10 (here adapted for X-band) disposed behind the main reflector 112 separated by a dielectric spacer 16 wherein the feed circuit 14 is also an antenna element of the array antenna 10**. With such an arrangement, an antenna system is provided wherein the array antenna provides low first sidelobe characteristics in both sum and delta signal patterns and very low far out RMS sidelobe levels for two orthogonal polarizations in a shared aperture environment.

The W-band antenna is a dual polarized Cassegrain reflector antenna which is nearly invisible at X-band. The latter is required since the reflectors of the W-band antenna are disposed in front of the X-band antenna. Since both antennas provide dual polarization characteristics, a fully dichroic subreflector 116 and main reflector 112 are required. Furthermore, to maximize the W-band aperture, a flat main reflector 112 is used.

The main reflector 112 is here provided as a flat, circularly shaped dielectric sheet with a plurality of so-called cross dipole strip conductors 118 disposed on the dielectric surface 112*a* thereof and a dichroic layer of cross dipole strip conductors on a second surface (not shown) thereof. The various length cross dipole strip conductors 118 are disposed to provide the main reflector 112 with electrical characteristics similar to a surface having a parabolic shape as shown in the teachings of U.S. Pat. No. 4,905,014 entitled "Microwave Phasing Structures For Electromagnetically Emulating Reflective Surfaces and Focusing Elements of Selected Geometry", issued to Gonzalez et al. It is desirable to use such a reflector shape since, inter alia, such a flat surface allows more room for gimbal positioning and is cheaper and easier to manufacture than a parabolic surface. The dichroic layer on the second surface serves to provide an effective ground plane to surface 112*a*, but is transparent to the array antenna 10. Alternatively, the main reflector 112 may be provided as a single layer dichroic member having a parabolically shaped surface.

The main reflector 112 includes two parallel frequency selective surfaces separated by a thin (i.e. 0.010 inch thick) dielectric substrate which emulate a metallic parabolic surface at W-band while providing a low loss transmission path at X-band. The main reflector 112 is separated from the X-band antenna 10 by a low dielectric constant foam spacer 16 (here approximately 0.100 inches thick) to minimize disturbance to the X-band patch radiator characteristics. The subreflector 116 is provided with the dichroic surface 128 which will reflect W-band signals but pass other signals. The subreflector 116 is supported by, here four, members 120, 122, 124 and 126, which are connected between the main reflector 112 and the subreflector 116, as shown, to secure the subreflector 116 in a fixed position relative to the main reflector 112. The thin support members 120 ... 126 are here provided from a material having sufficient mechanical strength to support the subreflector 116. Those of skill in the art will also recognize that it is desirable to arrange support members 120 ... 126 to minimize the amount of blockage provided to electromagnetic signals which propagate from the main reflector 112 toward the subreflector 116. Here, the support members 120 ... 126 are provided with a rectangular cross sectional shape and having a so-called knife-edge. The knife-edge of the support members 120 ... 126 are directed toward the direction of the propagating electric field. The support members 120 ... 126 have a relatively small cross-sectional area and thus a relatively small blockage to propagating electromagnetic signals. Alternatively, other known techniques for affixing the position of the subreflector 116 relative to the feed circuit 14 can be employed. For example, a cylindrical member having a first base connected to the feed circuit 14 and a second base connected to the subreflector 116 could be used. Such a cylindrical member must have a low relative dielectric constant and provide low insertion loss and phase dispersion characteristics to radio frequency (RF) signals.

The antenna system 100 may operate in either a transmit or a receive mode. The operation of the antenna system 100 and in particular the operation of the dual reflector antenna 110 may be more easily understood by following the path of an electromagnetic signal while the reflector antenna 110 operates in a receive mode. In the receive mode, radio frequency (RF) signals reflected from a potential target (not shown) propagates toward the main reflector 112. The main reflector 112 reflects the RF signals captured toward the curved subreflector 116. The dichroic surface 112*a* with the plurality of so-called cross dipole strip conductors 118 of the main reflector 112 is selected such that electromagnetic signals reflected therefrom propagate toward the subreflector 116. The RF signal reflects off the dichroic surface 128 of the subreflector 116 and propagates towards the feed circuit 14. In a preferred situation, the subreflector 116 intercepts all of the RF signals or electromagnetic energy fed thereto from the main reflector 112. Those of skill in the art will recognize that the feed circuit 14 and placement of the feed circuit 14 in the aperture 114 are selected such that the RF signals emitted from the first port 14*a* of the feed circuit 14 when in the transmit mode is incident upon or "illuminates" the complete dichroic surface 128 of the subreflector 116 while minimizing the amount of RF energy which propagates beyond the edges of the dichroic surface 128 of the subreflector 116 (i.e. minimizing the so-called spillover energy). Alternatively, when in the receive mode, essentially all of the RF signals captured by the main reflector 112 are reflected by the subreflector 116 and fed to the first port 14*a* of the feed circuit 14.

The RF signals propagate along the feed circuit 14 to the second port 14*b* wherein such signals are coupled, via a quasioptical rotary joint (not shown), to a diplexer (not shown), such as a diplexer described in U.S. Pat. No. 5,034,750, entitled "Pulse Radar and Components Therefor", issued Jul. 23, 1991 and assigned to the same assignee as the present application, for further processing. The details of feed circuit 14 will be described further hereinafter. Suffice it to say now, the feed circuit 14 is a cylindrical tube including a lens 18 to focus the signal from the diplexer (not shown) entering port 14*b* to a focal plane of appropriate size and located to correspond with the focal plane of the subreflector 116 and to also focus the RF signals from the subreflector 116 entering port 14*a* to a focal plane of appropriate size and located to correspond with the focal plane of a propagation circuit (not shown) wherein the RF signal is coupled to the diplexer (not shown).

Figure 2:
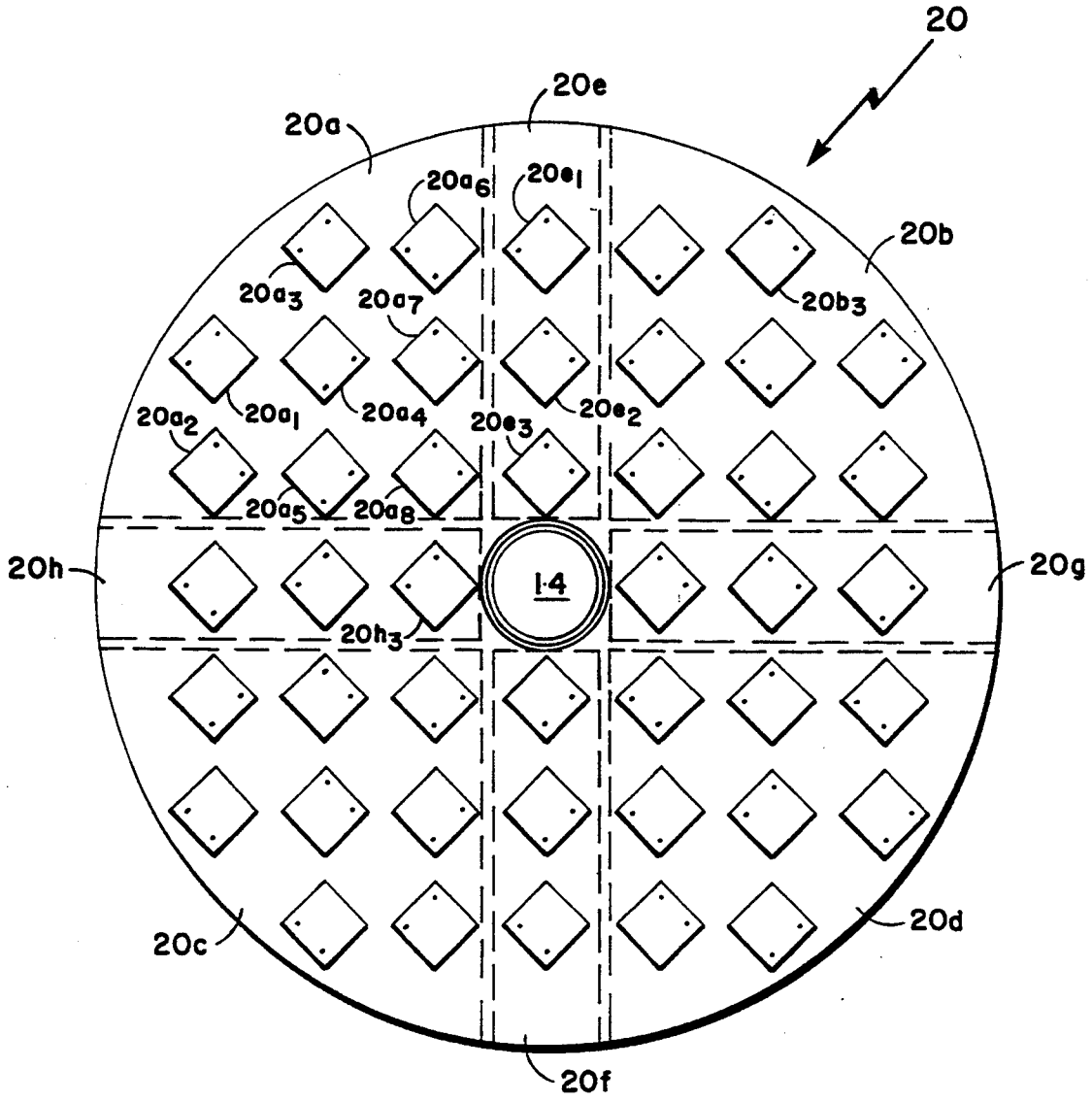
FIG. 2 is a plan view of an array of patch radiators and a common dual band center feed according to the invention.

Referring now also to FIG. 2, the array antenna 10 includes, here, 44 dual polarized patch radiator elements 20 and one circular waveguide radiator element, the circular waveguide radiator element provided by the feed circuit 14. The 44 dual polarized patch radiator elements 20 are grouped into eight segments 20*a*, 20*b*, 20*c*, 20*d*, 20*e*, 20*f*, 20*g* and 20*h* as shown. Segment 20*a* includes patch radiator elements $20a_1$, $20a_2$, $20a_3$, $20a_4$, $20a_5$, $20a_6$, $20a_7$ and $20a_8$ disposed as shown. Segment 20*b* includes eight patch radiator elements (not numbered) disposed as shown, segment 20c includes eight patch radiator elements (not numbered) disposed as shown and segment 20d includes eight patch radiator elements (not numbered) disposed as shown. Segment 20e includes patch radiator elements $20e_1$, $20e_2$ and $20e_3$ disposed as shown. Segment 20f includes three patch radiator elements (not numbered) disposed as shown, segment 20g includes three patch radiator elements (not numbered) disposed as shown and segment 20h includes three patch radiator elements (not numbered) disposed as shown. The eight segments 20a, 20b, 20c, 20d, 20e, 20f, 20g and 20h and the feed circuit 14 provide a nine segment antenna configuration wherein all nine segments are used for the sum channel and 6 and 4 segments are used for the difference and Q channels, respectively, for monopulse processing as described further hereinafter. To provide a low profile, printed circuit techniques are used to provide the RF segment distribution networks, monopulse circuitry and patch radiating elements. To provide the requisite frequency bandwidth, a corporate type feed network with equal path lengths is utilized. The printed circuit board construction results in an X-band antenna that is less than 0.5 inches thick. The array antenna 10 further includes several layers of printed circuits wherein the front layer includes the patch radiating elements 20 and each successive layer includes the required signal distribution and monopulse arithmetic circuitry required for dual polarization.

Figure 3:
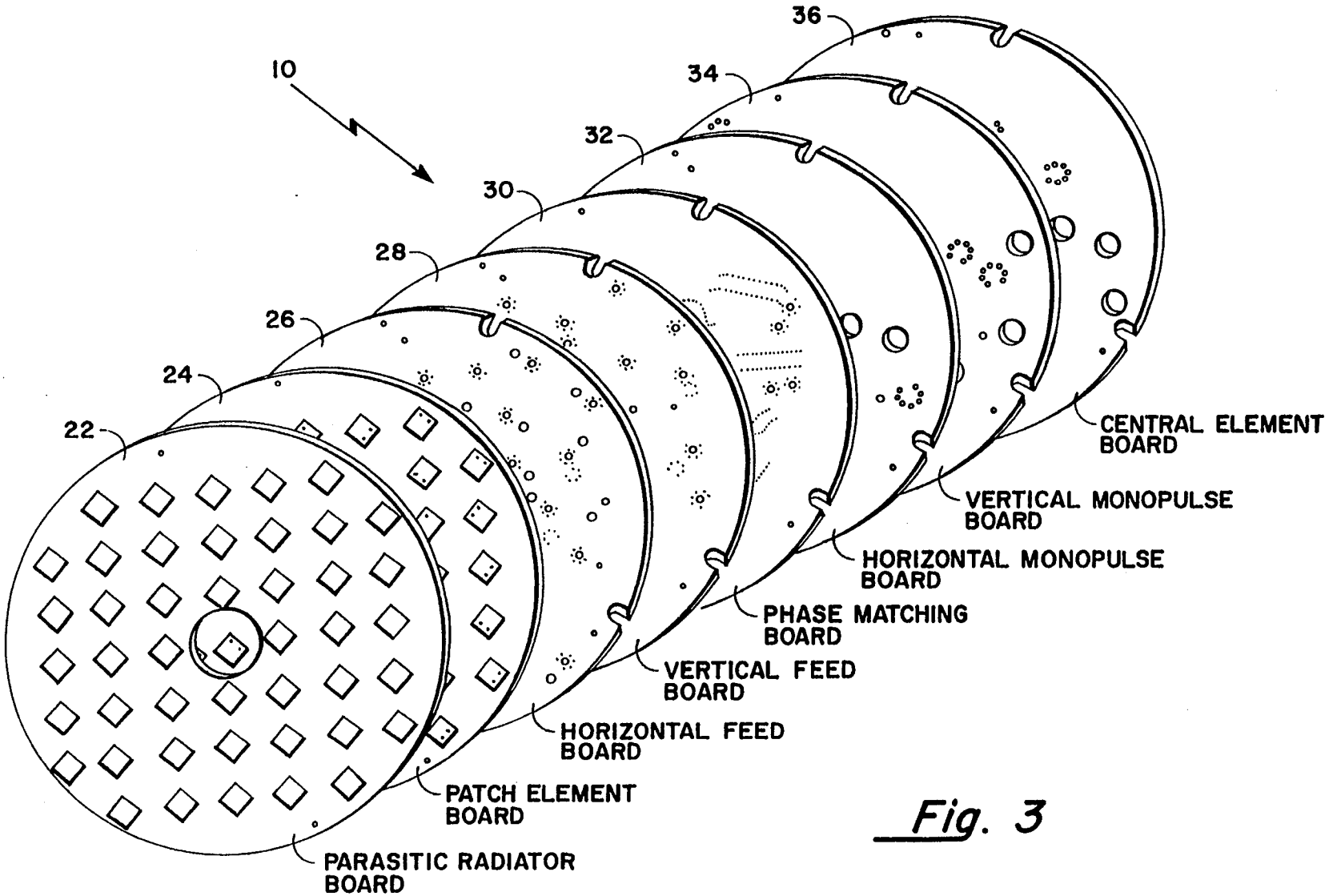
FIG. 3 is a plan view of a portion of each layer of a monopulse array antenna with a corporate feed according to the invention.

Referring now to FIG. 3, the array antenna 10 is here shown to include eight layers of printed circuit boards including a parasitic radiator board 22, a patch element board 24, a horizontal feed board 26, a vertical feed board 28, a phase matching board 30, a horizontal monopulse board 32, a vertical monopulse board 34 and a central element board 36. RF signals are coupled from one of the printed circuit boards to another one of the printed circuit boards by interboard coaxial TEM mode RF feed through (not shown). A pin and socket arrangement is utilized as the center conductor of the coaxial section and is soldered to the stripline circuitry on each of the layers being connected. Intervening layers between circuits being connected include appropriate coaxial sections formed by plated outer conductor holes and sized dielectric plug inserts. Four-port stripline hybrids are used throughout the signal distribution and monopulse combining circuitry. Wilkinson-type power dividers are used in the feed distribution networks and single-section branchline couplers are used in the monopulse combining networks. Mode suppression holes are installed in each stripline layer around each right angle transition as required and a conductive epoxy bond film is inserted between each board to provide a continuous ground between each one of the stripline boards.

Figure 2A:
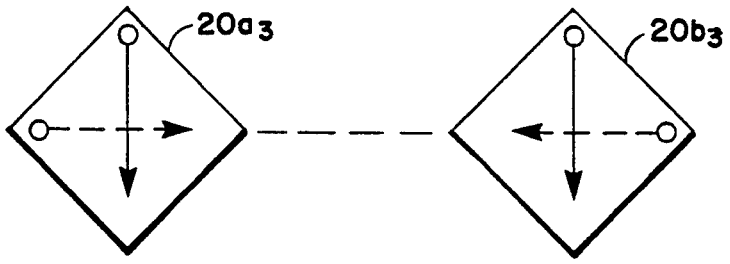
FIG. 2A is a plan view of two of the patch radiators showing the location of probe feeds according to the invention.

Referring now to FIGS. 2, 2A and 3, each of the antenna elements $20a_1$ ... $20h_3$ include a stacked square microstrip patch radiator. To provide low cross-polarization, good VSWR match and high radiation efficiency over a desired frequency bandwidth, the stacked square patch radiator antenna element is fed by a pair of coaxial probes with a first probe located in a corner and a second probe located in an adjacent corner. The lower patch is fed by a probe from a corresponding feed board while the upper patch is electromagnetically coupled to increase the bandwidth and gain of the antenna element. Thus, a feed probe (not numbered) of each patch on the patch element board 24 is coupled with stripline circuitry on the horizontal feed board 26 to provide a horizontally polarized signal. Furthermore, a feed probe (not numbered) of each patch on the patch element board 24 is coupled with stripline circuitry on the vertical feed board 28 to provide a vertically polarized signal. The location of each feed probe (not numbered) is shown in FIG. 2. Cross polarization on-axis sensitivity is decreased by placing each probe on alternate patches as shown if FIG. 2 so that a 180 degrees phase reversal would normally occur, but by adding a corresponding additional 180 degrees of path length in the feed circuit for the respective elements, an in phase copolarized signal is provided. The sense of polarization for the cross polarized component is unaffected by the reversal in probe location, however, a 180 degrees phase reversal due to the added length in the feed circuit occurs, such that alternate patches have a 180 degrees phase difference in cross polarized energy thereby decreasing the on-axis cross polarization sensitivity.

Figure 3A:
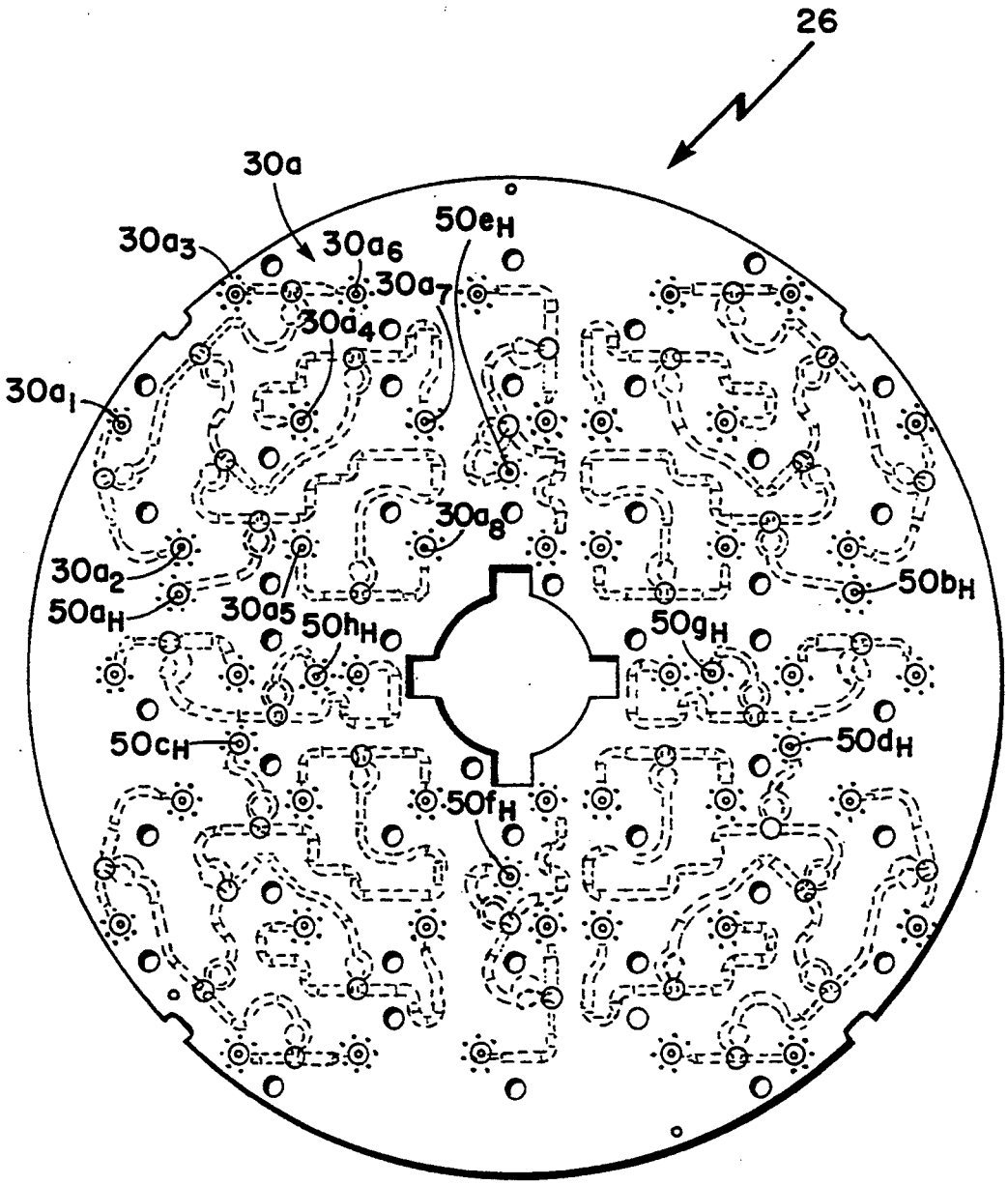
FIGS. 3A–3F are plan views showing the microstrip circuitry of each layer of the monopulse array antenna with the corporate feed according to the invention.

Referring now to FIGS. 2 and 3A, FIG. 3A shows detailed microstrip circuitry of the horizontal feed board 26. Although the X-band array antenna 10 (FIG. 1) operates in both a transmit and a receive mode, for explanation of operation we will assume we are in a receive mode. Here, the horizontally polarized signal from each antenna element within each segment are combined to provide eight output signals corresponding to the eight segments 20a ... 20h of FIG. 2. An impedance matching technique is used between each coaxial feed probe point and a corresponding stripline power divider on the horizontal feed board 26. A 50 ohm feed through with a 70 ohm section of transmission line is used to couple a feed probe point to the horizontal feed board 26. Microstrip circuitry disposed as shown with Wilkinson-type power dividers (not numbered) couples each of the feed through $30a_1$ ... $30a_8$ together to feed through $50a_H$. The latter couples signals from each of the feed through $30a_1$ ... $30a_8$ together to provide a combined horizontally polarized signal at the feed through $50a_H$. In a similar manner, each of the feed through coupled to a corresponding horizontal feed probe of the patches of segment 20b are coupled together to provide a combined horizontally polarized signal at feed through $50b_H$. Each of the feed throughs coupled to a corresponding horizontal feed probe of the patches of segment 20c are coupled together to provide a combined horizontally polarized signal at feed through $50c_H$. Each of the feed through coupled to a corresponding horizontal feed probe of the patches of segment 20d are coupled together to provide a combined horizontally polarized signal at feed through $50d_H$. Each of the feed throughs coupled to a corresponding horizontal feed probe of the patches of segment 20e are coupled together to provide a combined horizontally polarized signal at feed through $50e_H$. Each of the feed throughs coupled to a corresponding horizontal feed probe of the patches of segment 20f are coupled together to provide a combined horizontally polarized signal at feed through $50f_H$. Each of the feed throughs coupled to a corresponding horizontal feed probe of the patches of segment 20g are coupled together to provide a combined horizontally polarized signal at feed through $50g_H$. Finally, each of the feed throughs coupled to a corresponding horizontal feed probe of the patches of segment 20h are coupled together to provide a combined horizontally polarized signal at feed through $50h_H$.

Figure 3B:
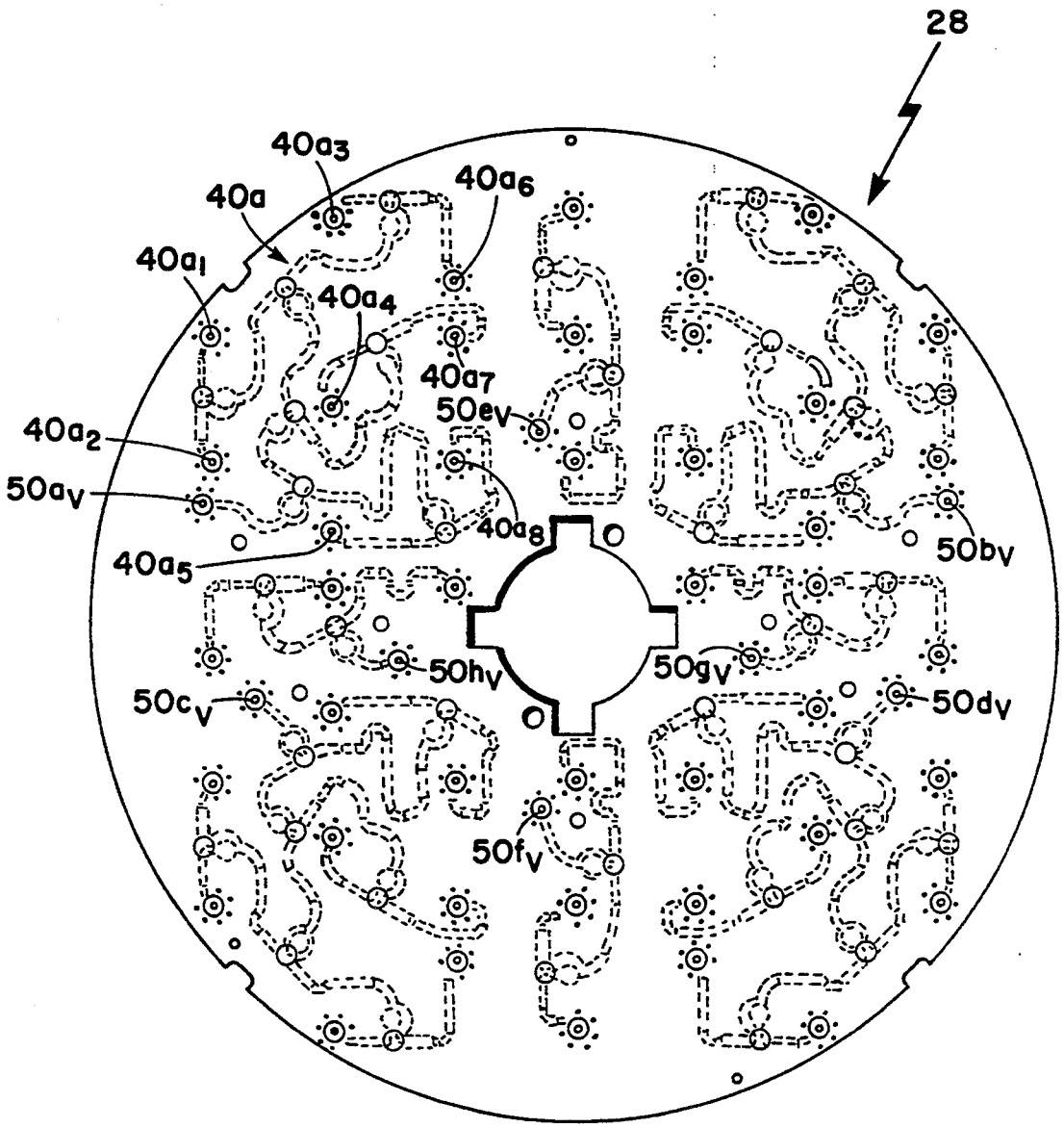
Figure 3C:
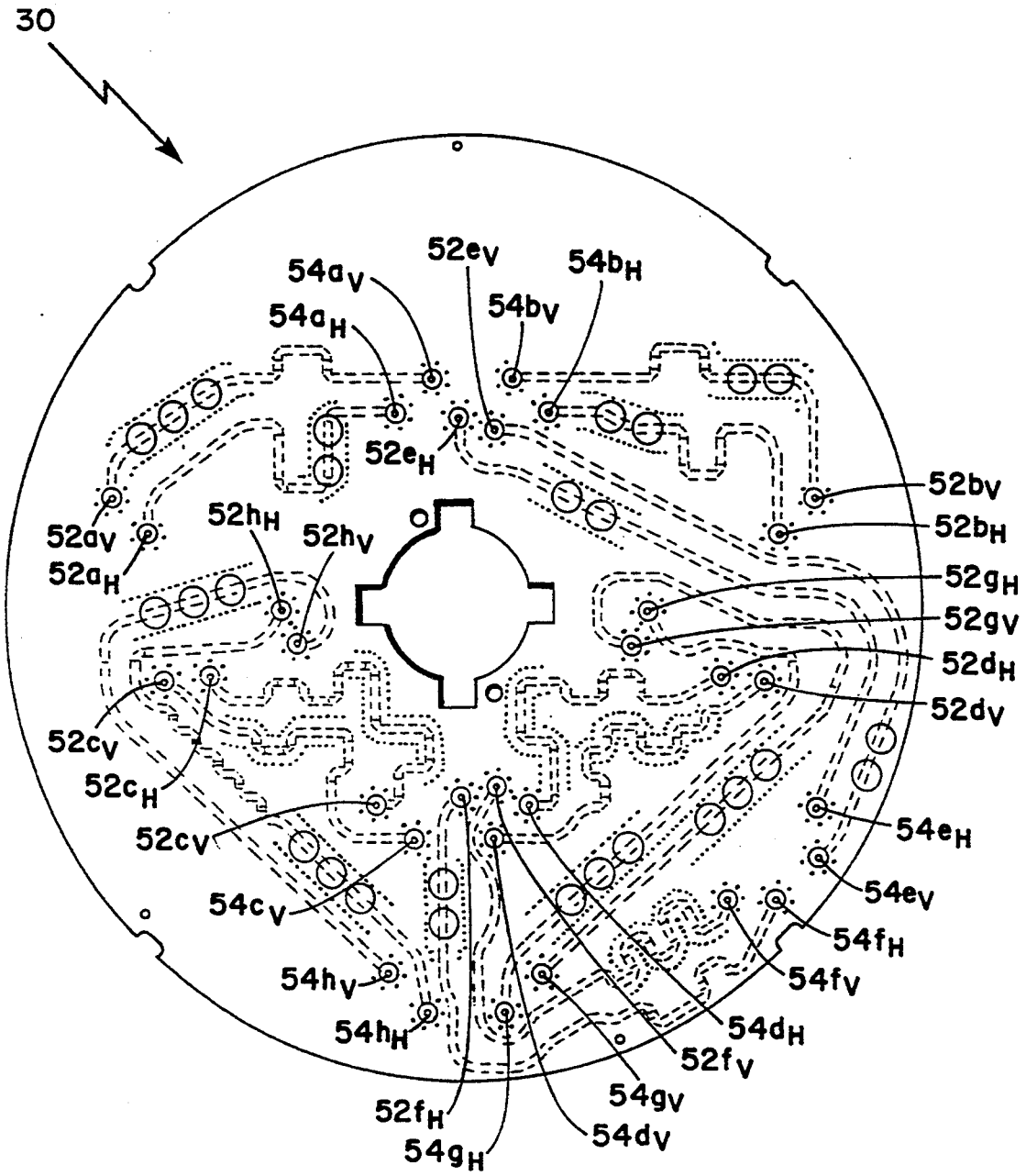

Referring now to FIGS. 2 and 3B, FIG. 3B shows detailed microstrip circuitry of the vertical feed board 28. Here, the vertically polarized signal from each antenna element within each segment are combined to provide eight output signals corresponding to the eight segments 20*a* ... 20*h* of FIG. 2. An impedance matching technique is used between each coaxial feed probe point and a corresponding stripline power divider on the vertical feed board 28. A 60 ohm feed through with a 75 ohm section of transmission line is used to couple a feed probe point to the vertical feed board 28. In segment 40*a* of the vertical feed board 28, which corresponds to segment 20*a* of FIG.2, feed through $\mathbf{40}a_1$ is coupled to patch $\mathbf{20}a_1$, feed through $\mathbf{40}a_2$ is coupled to patch $\mathbf{20}a_2$, feed through $\mathbf{40}a_3$ is coupled to patch $\mathbf{20}a_3$, feed through $\mathbf{40}a_4$ is coupled to patch $\mathbf{20}a_4$, feed through $\mathbf{40}a_5$ is coupled to patch $\mathbf{20}a_5$, feed through $\mathbf{40}a_6$ is coupled to patch $\mathbf{20}a_6$, feed through $\mathbf{40}a_7$ is coupled to patch $\mathbf{20}a_7$ and feed through $\mathbf{40}a_8$ is coupled to patch $\mathbf{20}a_8$. Microstrip circuitry disposed as shown with Wilkinson-type power dividers (not numbered) couples each of the feed throughs $\mathbf{40}a_1$ ... $\mathbf{40}a_8$ coupled to a corresponding vertical feed probe of the patches of segment 20*a* together to provide a combined vertically polarized signal at the feed through $\mathbf{50}a_v$. In a similar manner, each of the feed throughs coupled to a corresponding vertical feed probe of the patches of segment 20*b* are coupled together to provide a combined vertically polarized signal at feed through $\mathbf{50}b_v$. Each of the feed throughs coupled to a corresponding vertical feed probe of the patches of segment 20*c* are coupled together to provide a combined vertically polarized signal at feed through $\mathbf{50}c_v$. Each of the feed throughs coupled to a corresponding vertical feed probe of the patches of segment 20*d* are coupled together to provide a combined vertically polarized signal at feed through $\mathbf{50}d_v$. Each of the feed throughs coupled to a corresponding vertical feed probe of the patches of segment 20*e* are coupled together to provide a combined vertically polarized signal at feed through $\mathbf{50}e_v$. Each of the feed throughs coupled to a corresponding vertical feed probe of the patches of segment 20*f* are coupled together to provide a combined vertically polarized signal at feed through $\mathbf{50}f_v$. Each of the feed throughs coupled to a corresponding vertical feed probe of the patches of segment 20*g* are coupled together to provide a combined vertically polarized signal at feed through $\mathbf{50}g_v$. Finally, each of the feed throughs coupled to a corresponding vertical feed probe of the patches of segment 20*h* are coupled together to provide a combined vertically polarized signal at feed through $\mathbf{50}h_v$.

Referring now to FIGS. 3A, 3B, 3C, 3D, 3E and 3F, FIG. 3C shows detailed microstrip circuitry of the phase matching board 30. The positioning of various network inputs and outputs requires the necessity to phase match the total transmission line length to each antenna element. Phase matching circuitry on the phase matching board 30 provides the necessary phase match. Feed through $\mathbf{52}a_H$ is coupled to feed through $\mathbf{50}a_H$ wherein the horizontally polarized signal from segment 20*a* is coupled to the phase matching board 30. Feed through $\mathbf{52}a_v$ is coupled to feed through $\mathbf{50}a_v$ wherein the vertically polarized signal from segment 20*a* is coupled to the phase matching board 30. Microstrip circuitry connects the feed through $\mathbf{52}a_H$ to a feed through $\mathbf{54}a_H$ wherein a predetermined amount of phase difference is imparted to a signal propagating thereon to provide the necessary phase match. In a similar manner, microstrip circuitry imparting the necessary phase shift to a signal propagating thereon connects feed through $\mathbf{52}a_v$ to feed through $\mathbf{54}a_v$. Feed through $\mathbf{52}b_H$ is coupled to feed through $\mathbf{50}b_H$ wherein the horizontally polarized signal from segment 20*b* is coupled to the phase matching board 30. Feed through $\mathbf{52}b_v$ is coupled to feed through $\mathbf{50}b_v$ wherein the vertically polarized signal from segment 20*b* is coupled to the phase matching board 30. Microstrip circuitry connects feed through $\mathbf{52}b_H$ to feed through $\mathbf{54}b_H$ and microstrip circuitry connects feed through $\mathbf{52}b_v$ to feed through $\mathbf{52}b_v$. Furthermore, feed throughs $\mathbf{52}c_H$, $\mathbf{52}c_v$, $\mathbf{52}d_H$, $\mathbf{52}d_v$, $\mathbf{52}e_H$, $\mathbf{52}e_v$, $\mathbf{52}f_H$, $\mathbf{52}f_v$, $\mathbf{52}g_H$, $\mathbf{52}g_v$, $\mathbf{52}h_H$ and $\mathbf{52}h_v$ are coupled respectively to feed throughs $\mathbf{50}c_H$, $\mathbf{50}c_v$, $\mathbf{50}d_H$, $\mathbf{50}d_v$, $\mathbf{50}e_H$, $\mathbf{50}e_v$, $\mathbf{50}f_H$, $\mathbf{50}f_v$, $\mathbf{50}g_H$, $\mathbf{50}g_v$, $\mathbf{50}h_H$ and $\mathbf{50}h_v$. Microstrip circuitry connects feed throughs $\mathbf{52}c_H$, $\mathbf{52}c_v$, $\mathbf{52}d_H$, $\mathbf{52}d_v$, $\mathbf{52}e_H$, $\mathbf{52}e_v$, $\mathbf{52}f_H$, $\mathbf{52}f_v$, $\mathbf{52}g_H$, $\mathbf{52}g_v$, $\mathbf{52}h_H$ and $\mathbf{52}h_v$, respectively to feed throughs $\mathbf{54}c_H$, $\mathbf{54}c_v$, $\mathbf{54}d_H$, $\mathbf{54}d_v$, $\mathbf{54}e_H$, $\mathbf{54}e_v$, $\mathbf{54}f_H$, $\mathbf{54}f_v$, $\mathbf{54}\ g_H$, $\mathbf{54}g_v$, $\mathbf{54}h_H$ and $\mathbf{54}h_v$ as shown. Mode suppression holes (not numbered) are disposed around each right angle transitions as required.

Figure 3D:
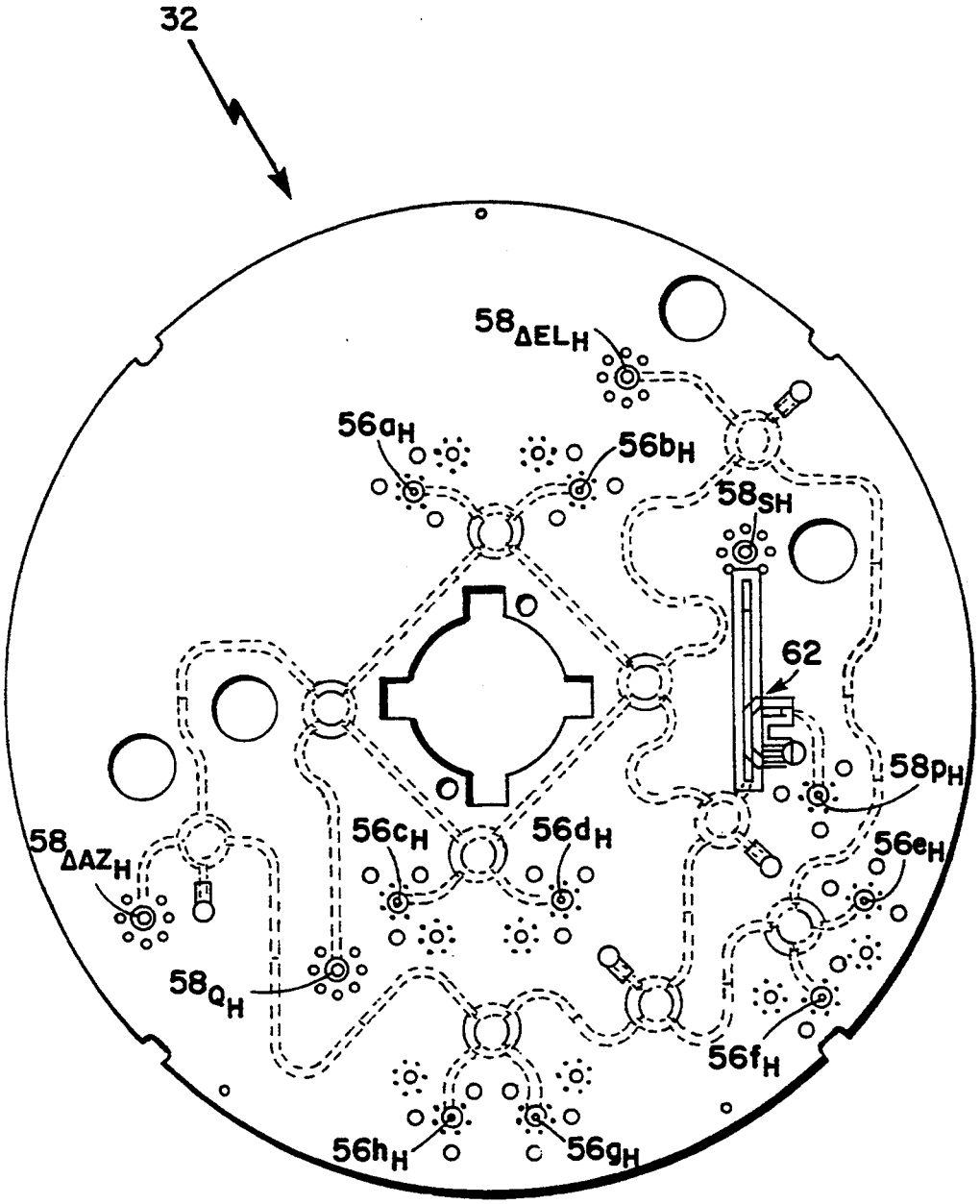

FIG. 3D shows detailed microstrip circuitry of the horizontal monopulse board 32. Here, the horizontally polarized signals from each antenna segment are combined in a manner as to be described further in connection with FIG. 5. The horizontal monopulse board 32 includes a monopulse network to provide a sum signal, an azimuth difference signal, an elevation difference signal and a Q signal for the horizontally polarized signals. A feed through $\mathbf{56}a_H$ is coupled to the feed through $\mathbf{54}a_H$ on the phase matching board 30. Similarly, feed throughs $\mathbf{56}b_H$, $\mathbf{56}c_H$, $\mathbf{56}d_H$, $\mathbf{56}e_H$, $\mathbf{56}f_H$, $\mathbf{56}g_H$ and $\mathbf{56}h_H$ are respectively coupled to the feed throughs $\mathbf{54}b_H$, $\mathbf{54}b_H$, $\mathbf{54}c_H$, $\mathbf{54}d_H$, $\mathbf{54}e_H$, $\mathbf{54}f_H$, $\mathbf{54}g_H$ and $\mathbf{54}h_H$ on the phase matching board 30. Using 4-port stripline hybrids (not numbered), here branch line hybrids, microstrip circuitry is used to combine the horizontally polarized signals from the antenna segments 20*a* ... 20*h* as required to implement the horizontal signal monopulse arithmetic network. At feed through $\mathbf{58}_{\Delta ZAH}$, the horizontal monopulse azimuth difference signal is provided. At feed through $\mathbf{58}_{\Delta ELH}$, the horizontal monopulse elevation difference signal is provided. At feed through $\mathbf{58}_{QH}$, the horizontal monopulse Q signal is provided.

Figure 3E:
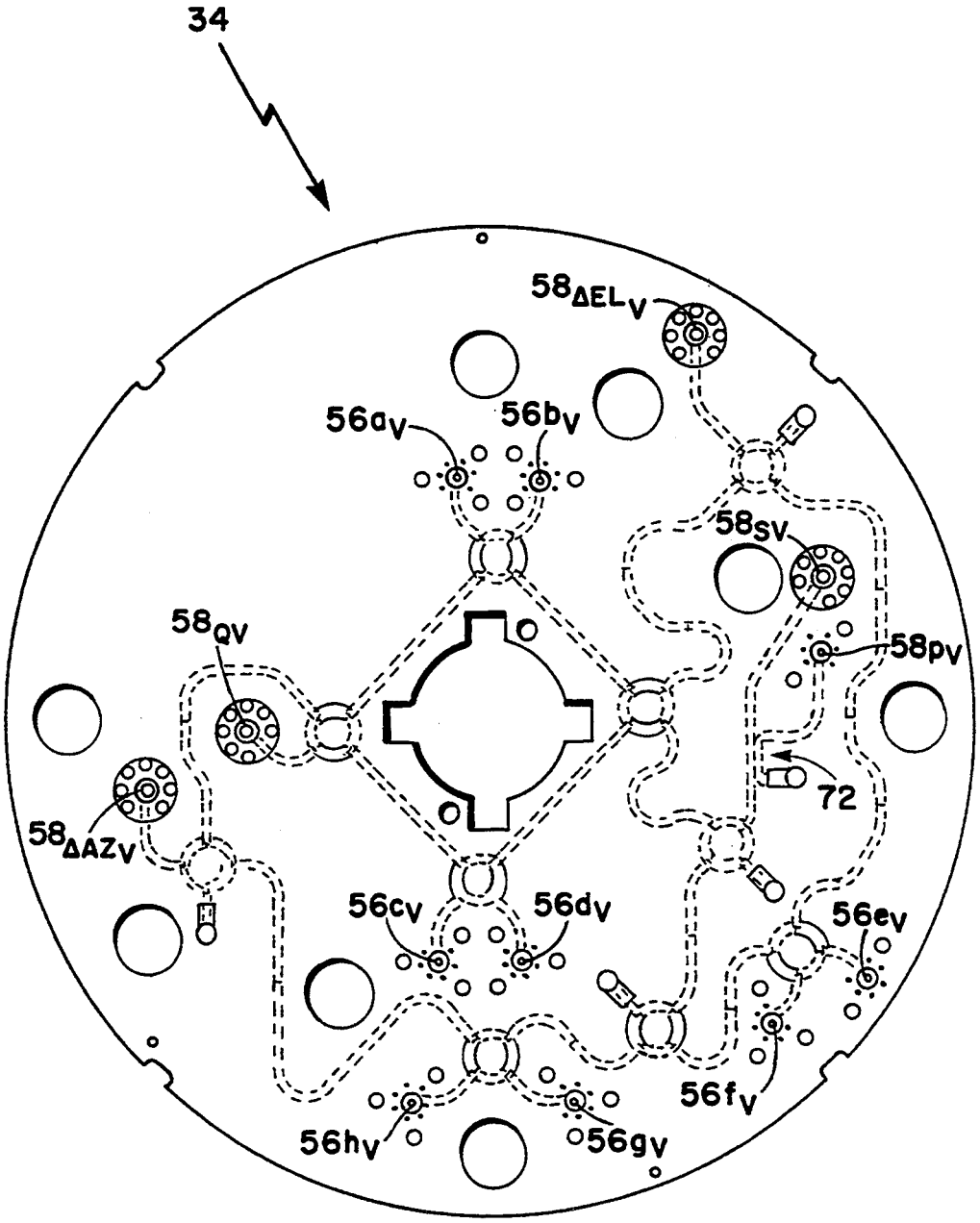
Figure 3F:
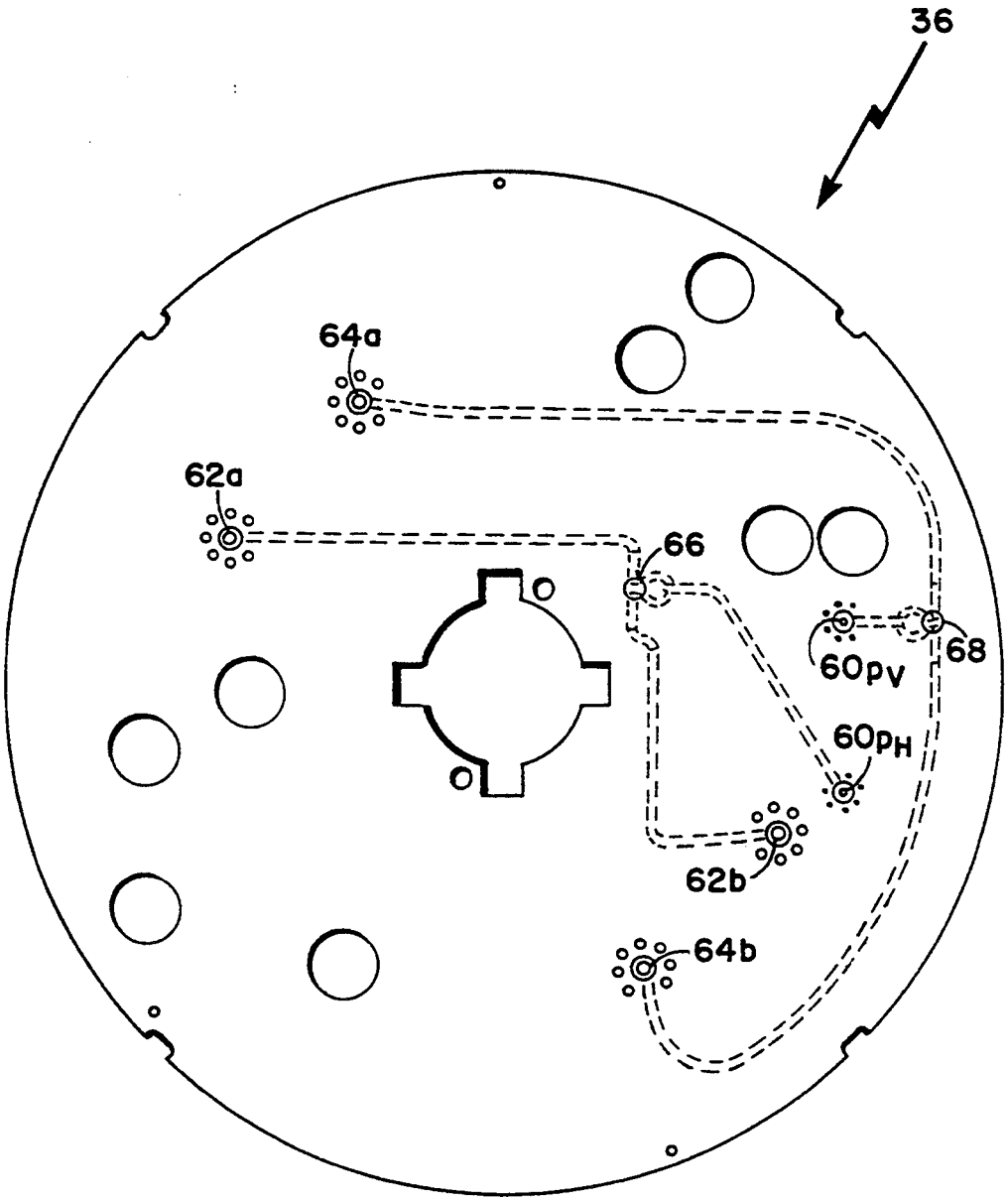

Referring momentarily also to FIG. 3F, the detailed microstrip circuitry of the central element board 36 is shown. The central element board 36 combines the signals from the feed probes of the feed element 14 (FIG. 1A). The horizontal feed probes (not shown) of the feed element are coupled, via coaxial cables (not shown), to respective feed throughs 62*a*, 62*b*. A Wilkinson-type power divider 66 is used to couple the two signals from the feed throughs 62*a*, 62*b* to a feed through $\mathbf{60}p_H$. The feed through $\mathbf{60}p_H$ couples the horizontally polarized signal from the horizontal feed probes (not shown) to the horizontal monopulse board 32. In a similar manner, the vertical feed probes (not shown) are coupled, via coaxial cables (not shown), to respective feed throughs 64*a*, 64*b*. A Wilkinson-type power divider 68 is used to couple the two signals from the feed throughs 64*a*, 64*b* to a feed through $\mathbf{60}p_v$. The feed through $\mathbf{60}p_v$ couples the vertically polarized signal from the vertical feed probes (not shown) to the vertical monopulse board 34 (FIG. 3E).

Referring now again to FIG. 3D, a feed through $\mathbf{58}p_H$, which is coupled to the feed through $\mathbf{60}p_H$ (FIG. 3F), is connected to a single section edge line coupler 62. The single section edge line coupler 62 is used to couple a portion of the sum signal which was combined from the feed throughs $56a_H$, $56b_H$, $56c_H$, $56d_H$, $56e_H$, $56f_H$, $56g_H$ and $56h_H$ with the portion of the sum signal from the feed through $58p_H$. The output port of the single section edge line coupler 62 is coupled to a feed through $58_{SH}$ wherein the horizontally polarized monopulse sum signal is provided. A terminating resistor (not numbered) is connected to the remaining port of the single section edge line coupler 62 to terminate the uncoupled port. Terminating resistors (not numbered) are also used, when required, to terminate an unused port of the 4-port stripline hybrids.

FIG. 3E shows detailed microstrip circuitry of the vertical monopulse board 34. Here, the vertically polarized signals from each antenna segment are combined in the manner as to be described further in connection with FIG. 5. The vertical monopulse board 34 includes a monopulse network to provide a sum signal, an azimuth difference signal, an elevation difference signal and a Q signal for the vertically polarized signals. A feed through $56a_v$ is coupled to the feed through $54a_v$ on the phase matching board 30. Similarly, feed throughs $56b_v$, $56c_v$, $56d_v$, $56e_v$, $56f_v$, $56g_v$ and $56h_v$ are respectively coupled to the feed throughs $54b_v$, $54b_v$, $54c_v$, $54d_v$, $54e_v$, $54f_v$, $54g_v$ and $54h_v$ on the phase matching board 30. Using 4-port stripline hybrids (not numbered), here branch line hybrids, microstrip circuitry is used to combine the vertically polarized signals from the antenna segments 20*a* ... 20*h* as required to implement the vertical signal monopulse arithmetic network. At feed through $58_{\Delta AZv}$, the vertical monopulse azimuth difference signal is provided. At feed through $58_{\Delta ELv}$, the vertical monopulse elevation difference signal is provided. At feed through $58_{Qv}$, the vertical monopulse Q signal is provided. A feed through $58p_v$, which is connected to the feed through $60p_v$ (FIG. 3F), is coupled to a single section edge line coupler 72. The single section edge line coupler 72 is used to couple a portion of the sum signal which was combined from the feed throughs $56a_v$, $56b_v$, $56c_v$, $56d_v$, $56e_v$, $56f_v$, $56g_v$ and $56h_v$ with the portion of the sum signal from the feed through $58p_v$. The output port of the single section edge line coupler is coupled to a feed through $58_{Sv}$ wherein the vertically polarized sum signal is provided. A terminating resistor (not numbered) is connected to the remaining port of the single section edge line coupler 72 to terminate the uncoupled port.

As described hereinbefore, four-port stripline hybrids are used throughout the signal distribution and monopulse combining circuitry. Wilkinson-type power dividers are used in the feed distribution networks. Single-section branchline couplers are used in the monopulse combining networks. Coaxial TEMRF feed throughs are utilized to couple energy between the various stripline circuit boards. Mode suppression holes are installed in each stripline layer around each right angle transition and a conductive epoxy bond film is inserted between each board to provide a continuous ground between each stripline layer. A pin and socket arrangement is utilized as the center conductor of each coaxial section and is soldered to the stripline circuitry on each of the layers being connected. Intervening layers between circuits being connected include appropriate coaxial sections formed by plated outer conductor holes and sized dielectric plug inserts.

Figure 4:
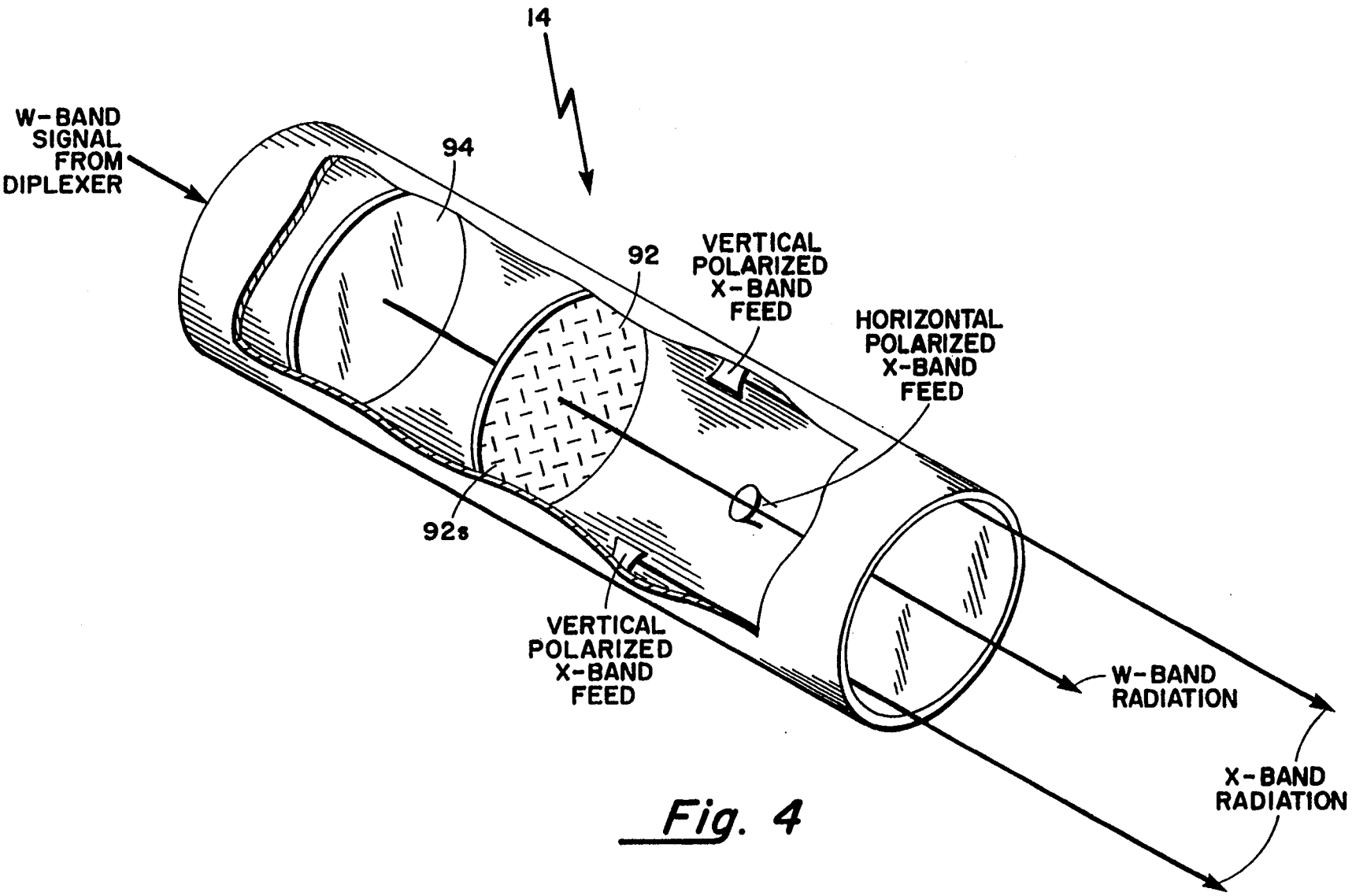
FIG. 4 is an isometric view, partially torn away of the common dual band center feed according to the invention.

Referring now to FIG. 4, the feed circuit 14 functioning as the center element of the array antenna 10 is here an open ended circular waveguide. The feed circuit 14 is excited by two probes (not numbered) for each polarization to provide a TE11 mode signal and suppress the TM01 mode signal at X-band. Signals from the two pairs of exciter probes are connected to the central element board 36, combined and added to the sum port of each polarization of the X-band signals. A plate 92 with a slotted dichroic surface 92*s* is disposed behind the exciter probes to block X-band signals from propagating in that direction but allowing W-band signals to pass freely. A lens 94, here made of alumina, is shown behind the plate 92 to control the beam waist of the W-band signal. The lens 94 is disposed at a location to focus the Gaussian beam of the W-band signal to form a virtual focal plane slightly beyond the main reflector 112 (FIG. 1). Knowing the characteristics of the Gaussian beam size, the X-band exciter probes are disposed to minimize interference with the W-band signal.

Figure 5:
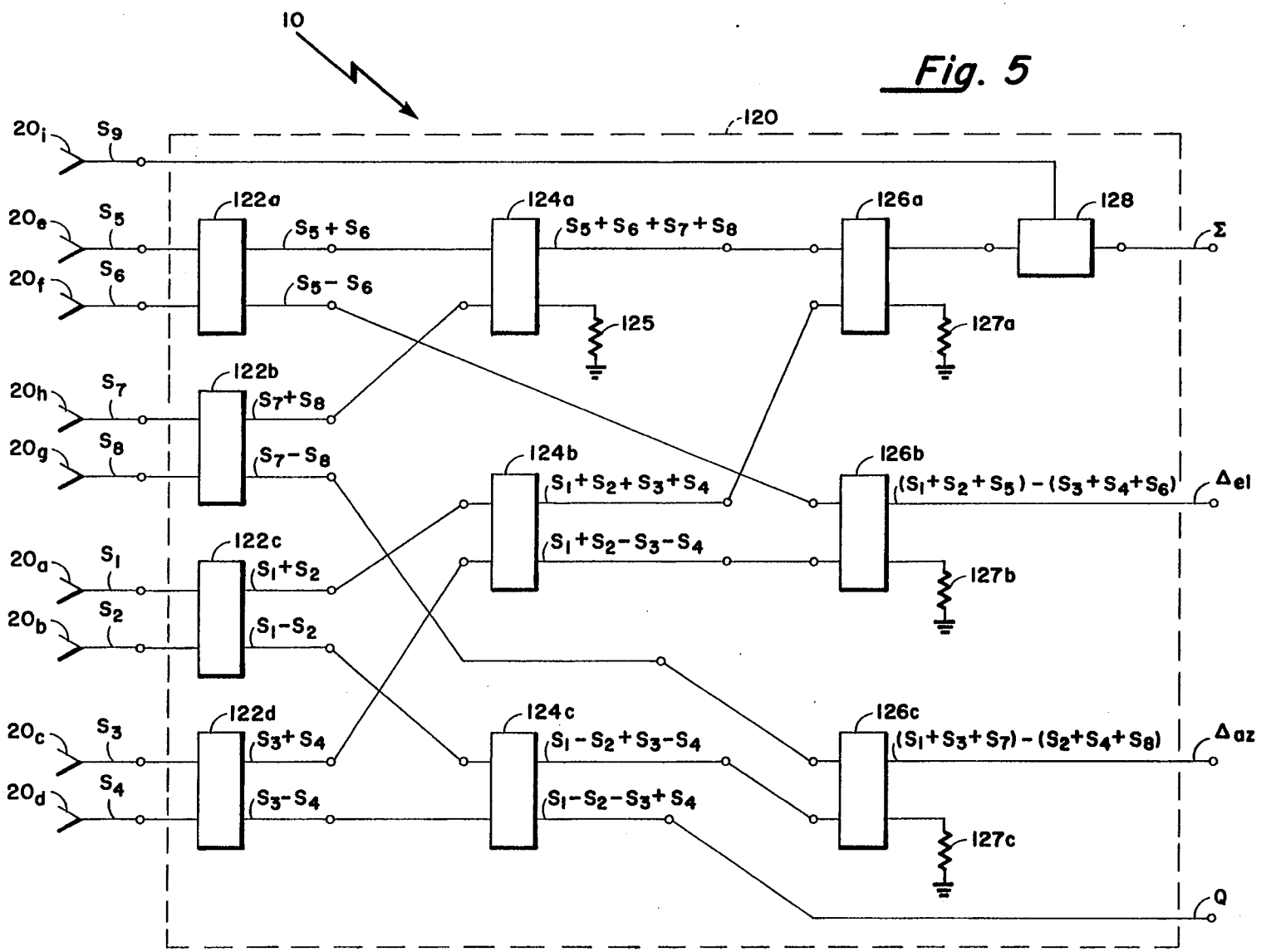
FIG. 5 is a diagrammatical sketch of the feed to provide monopulse sum and difference signals for the array according to the invention.

Referring now to FIG. 5, a block diagram of a nine segment monopulse network 120 here implemented is described. Antenna segments 20*a*, 20*b*, 20*c*, 20*d*, 20*e*, 20*f*, 20*g* and 20*h* are shown to provide respective signals $S_1$, $S_2$, $S_3$, $S_4$, $S_6$, $S_8$ and $S_7$. Antenna segment 20*i*, here provided by feed circuit 14 (FIG. 1), provides signal $S_9$. A plurality of power dividers 122*a*, 122*b*, 122*c*, 122*d*, 124*a*, 124*b*, 124*c*, 126*a*, 126*b* and 126*c* are shown, each having a first and a second input port and a sum and a difference output port. A power divider 128 having a first and a second input port and an output port is also shown. To provide the required monopulse network 120 with outputs including a sum signal, an azimuth difference signal, an elevation difference signal and a Q signal, the plurality of power dividers 122*a* ... 128 are arranged as shown. The output signal $S_1$ of segment 20*a* is fed to the first input port of power divider 122*c* and the output signal $S_2$ of segment 20*b* is fed to the second input of power divider 122*c* wherein such signals are combined to provide a sum signal $S_1+S_2$ at the sum output port and a difference signal $S_1-S_2$ at the difference output port of power divider 122*c*. The output signal $S_3$ of segment 20*c* is fed to the first input port of power divider 122*d* and the output signal $S_4$ of segment 20*d* is fed to the second input of power divider 122*d* wherein such signals are combined to provide a sum signal $S_3+S_4$ at the sum output port and a difference signal $S_1-S_4$ at the difference output port of power divider 122*d*. In a similar manner, the output signal $S_5$ of segment 20*e* is fed to the first input port of power divider 122*a* and the output signal $S_6$ of segment 20*f* is fed to the second input of power divider 122*a* wherein such signals are combined to provide a sum signal $S_5+S_6$ at the sum output port and a difference signal $S_5-S_6$ at the difference output port of power divider 122*a*. The output signal $S_7$ of segment 20*h* is fed to the first input port of power divider 122*b* and the output signal $S_8$ of segment 20*g* is fed to the second input of power divider 122*b* wherein such signals are combined to provide a sum signal $S_7+S_8$ at the sum output port and a difference signal $S_7-S_8$ at the difference output port of power divider 122*b*.

The sum signal $S_1+S_2$ is fed to the first input port of power divider 124*b* and the sum signal $S_3+S_4$ is fed to the second input of power divider 124*b* wherein such signals are combined to provide a sum signal $S_1+S_2+S_3+S_4$ at the sum output port and a difference signal $S_1+S_2-S_3-S_4$ at the difference output port of power divider 124*b*. Like wise, the sum signal $S_5+S_6$ is fed to the first input port of power divider 124*a* and the sum signal $S_7+S_8$ is fed to the second input of power divider 124a wherein such signals are combined to provide a sum signal $S_5+S_6+S_7+S_8$ at the sum output port and a difference signal $S_5+S_6-S_7-S_8$ at the difference output port of power divider 124a. Here, the difference signal $S_5+S_6-S_7-S_8$ is terminated with a terminating resistor 125 to ground. The difference signal $S_1-S_2$ is fed to the first input port of power divider 124c and the difference signal $S_3-S_4$ is fed to the second input of power divider 124c wherein such signals are combined to provide a signal $S_1-S_2+S_3-S_4$ at the sum output port and a signal $S_1-S_2-S_3+S_4$ at the difference output port of power divider 124c. The signal $S_1-S_2-S_3+S_4$ at the difference output port of power divider 124c is provided at an output port of the monopulse network 120 as the Q signal Q for the monopulse network 120.

The sum signal $S_5+S_6+S_7+S_8$ is fed to the first input port of power divider 126a and the sum signal $S_1+S_2+S_3+S_4$ is fed to the second input of power divider 126a wherein such signals are combined to provide a sum signal $S_1+S_2+S_3+S_4+S_5+S_6+S_7+S_8$ at the sum output port and a signal at the difference output port of power divider 126a. The signal at the difference output port of power divider 126a is terminated with a terminating resistor 127a to ground. The sum signal $S_1+S_2+S_3+S_4+S_5+S_6+S_7+S_8$ is fed to power divider 128 wherein such signal is added to the signal $S_9$ and a composite sum signal $\Sigma$ is provided at the output port of the power divider 128 which is the sum signal $\Sigma$ for the monopulse network 120.

The difference signal $S_5-S_6$ is fed to the first input port of power divider 126b and the difference signal $S_1+S_2-S_3-S_4$ is fed to the second input of power divider 126b wherein such signals are combined to provide a signal $(S_1+S_2+S_5)-(S_3+S_4+S_6)$ at the sum output port and a signal at the difference output port of power divider 126b. The signal at the difference output port of power divider 126b is terminated with a terminating resistor 127b to ground. The signal $(S_1+S_2+S_5)-(S_3+S_4+S_6)$ at the sum output port of power divider 126b is provided at an output port of the monopulse network 120 as the elevation difference signal $\Delta_{el}$ for the monopulse network 120.

The difference signal $S_7-S_8$ is fed to the first input port of power divider 126c and the signal $S_1-S_2'S_3-S_4$ is fed to the second input of power divider 126c wherein such signals are combined to provide a signal $(S_1+S_3+S_7)-(S_2+S_4+S_8)$ at the sum output port and a signal at the difference output port of power divider 126c. The signal at the difference output port of power divider 126c is terminated with a terminating resistor 127c to ground. The signal $(S_1+S_3+S_7)-(S_2+S_4+S_8)$ at the sum output port of power divider 126c is provided at an output port of the monopulse network 120 as the azimuth difference signal $\Delta_{az}$ for the monopulse network 120.

It should be appreciated the above described monopulse network 120 is implemented for the horizontally polarized signals provided from each of the segments 20a ... 20i and is also implemented for the vertically polarized signals provided from each of the segments 20a ... 20i.

Having described this invention, it will now be apparent to one of skill in the art that changes may be made without departing from the concept of providing a dual band, shared aperture antenna system including a reflector antenna, responsive to radio frequency signals at a first frequency, having a first reflector surface, a second reflector surface and a Cassegrain feed, the antenna system further including an array antenna having a plurality of antenna elements responsive to radio frequency signals having a second different frequency. It is felt, therefore, that this invention should not be restricted to its disclosed embodiment, but rather should be limited only by the spirit and scope of the appended claims.

What is claimed is:

1. An antenna comprising:

(a) a reflector antenna having an aperture and responsive to radio frequency signals having a first frequency, the reflector antenna comprising:

a first reflector;

a second reflector; and a Cassegrainian feed, the first reflector, the second reflector and the Cassegrainian feed disposed in a Cassegrain reflector antenna arrangement; and (b) an array antenna having an aperture, the array antenna comprising a plurality of antenna elements, each one of the antenna elements responsive to radio frequency signals having a second different frequency, the array antenna and the reflector antenna having a common aperture, the Cassegrainian feed comprising means for propagating radio frequency signals having the second different frequency for providing one of the plurality of antenna elements of the array antenna; and (c) a dielectric spacer disposed between the reflector antenna and the array antenna.

2. The antenna as recited in claim 1 wherein at least one of the plurality of antenna elements of the array antenna comprises:

(a) a dielectric layer having a first and second surface;

(b) a microstrip patch radiator element disposed adjacent the first surface of the dielectric layer; and (c) a parasitic radiator element disposed adjacent the second surface of the dielectric layer.

3. The antenna as recited in claim 2 wherein the microstrip patch radiator element comprises a first feed probe to provide a horizontally polarized signal and a second feed probe to provide a vertically polarized signal.

4. The antenna as recited in claim 3 wherein the feed probe of alternating microstrip patch radiator elements are placed in opposing locations within the microstrip patch radiator element.

5. The antenna as recited in claim 4 wherein the plurality of antenna elements of the array antenna are disposed to provide a monopulse antenna element arrangement.

6. The antenna as recited in claim 5 further comprising microstrip circuitry disposed on a plurality of successively layered printed circuit boards, the microstrip circuitry disposed to perform monopulse arithmetic to provide a monopulse sum signal, a monopulse azimuth difference signal and a monopulse elevation difference signal in response to a received signal coupled to the microstrip circuitry from the plurality of antenna elements.

7. (Amended) An antenna comprising:

(a) a first substrate having a first and a second surface with an opening disposed from said first surface to said second surface, the first substrate further having a plurality of antenna elements, responsive to a signal having a first frequency, disposed adjacent the first surface and a corresponding plurality of parasitic antenna elements disposed adjacent the second surface;

(b) a second substrate having a first and a second surface with an opening disposed from said first surface to said second surface, the second substrate further having a metallic pattern disposed on the first surface of the second substrate, the metallic pattern providing a dichroic surface transparent to signals having the first frequency;

(c) a dielectric spacer disposed between said first substrate and said second substrate, and (d) a Cassegrainian feed disposed in the opening of the first substrate and the opening of the second substrate, the Cassegrainian feed comprising means for feeding and receiving signals having the first frequency and for feeding and receiving signals having a second different frequency.

8. The antenna as recited in claim 7 wherein the plurality of antenna elements are disposed to provide a monopulse antenna element arrangement.

9. The antenna as recited in claim 8 further comprising microstrip circuitry disposed on a plurality of successively layered printed circuit boards, the microstrip circuitry disposed to perform monopulse arithmetic to provide a monopulse sum signal, a monopulse azimuth difference signal and a monopulse elevation difference signal in response to a received signal coupled to the microstrip circuitry from the plurality of antenna elements.

10. The antenna as recited in claim 9 wherein the microstrip circuitry disposed on a plurality of successively layered printed circuit boards comprises:

(a) a first printed circuit board having a plurality of inputs comprising microstrip circuity, connected to the plurality of inputs, disposed to perform monopulse arithmetic to provide a monopulse sum signal, a monopulse azimuth difference signal and a monopulse elevation difference signal;

(b) a second printed circuit board comprising microstrip circuitry to connect the plurality of antenna elements together into a plurality of outputs; and (c) a third printed circuit board, disposed between the first printed circuit board and the second printed circuit board, the third printed circuit board comprising microstrip circuitry to provide requisite path lengths to connect the plurality of outputs of the second printed circuit board with the plurality of inputs of the first printed circuit board.

11. The antenna as recited in claim 9 further comprising a reflector antenna comprising:

(a) a first reflector; and (b) a second reflector the first reflector, the second reflector and the Cassegrainian feed disposed in a Cassegrain reflector antenna arrangement.

12. An antenna comprising:

(a) first reflecting means for reflecting electromagnetic signals fed thereto, said first reflecting means having an opening therethrough;

(b) second reflecting means for reflecting electromagnetic signals fed thereto, said second reflecting means adapted to cooperate with said first reflecting means as a dual reflector antenna system;

(c) feed circuit means, disposed in the opening of said first reflecting means, for feeding and receiving electromagnetic signals having a first frequency to and from the second reflecting means and for feeding and receiving electromagnetic signals having a second different frequency; and (d) emanating means, disposed adjacent the first reflecting means, for feeding and receiving electromagnetic signals having the second different frequency, wherein the emanating means comprises a plurality of antenna elements comprising:

a dielectric layer having a first and second surface;

a microstrip patch radiator element disposed adjacent the first surface of the dielectric layer; and a parasitic radiator element disposed adjacent the second surface of the dielectric layer.

13. The antenna as recited in claim 12 wherein the microstrip patch radiator element comprises a first feed probe to provide a horizontally polarized signal and a second feed probe to provide a vertically polarized signal.

14. The antenna as recited in claim 13 wherein the feed probe of alternating microstrip patch radiator elements are placed in opposing locations within the microstrip patch radiator element.

15. The antenna as recited in claim 14 wherein the plurality of antenna elements are disposed to provide a monopulse antenna element arrangement.

16. The antenna as recited in claim 12 further comprising microstrip circuitry disposed on a plurality of successively layered printed circuit boards, the microstrip circuitry disposed to perform monopulse arithmetic to provide a monopulse sum signal, a monopulse azimuth difference signal and a monopulse elevation difference signal in response to a received signal coupled to the microstrip circuitry from the emanating means.

* * * * *